US009157572B1

(12) United States Patent
Merideth

(10) Patent No.: US 9,157,572 B1
(45) Date of Patent: Oct. 13, 2015

(54) AIR CONDITIONER ROOF SUPPORT SYSTEM

(71) Applicant: Mark Ray Merideth, Roseville, CA (US)

(72) Inventor: Mark Ray Merideth, Roseville, CA (US)

( * ) Notice: Subject to any disclaimer, the term of this patent is extended or adjusted under 35 U.S.C. 154(b) by 0 days.

(21) Appl. No.: 14/055,014

(22) Filed: Oct. 16, 2013

Related U.S. Application Data

(63) Continuation-in-part of application No. 12/660,791, filed on Mar. 4, 2010, now Pat. No. 8,640,477.

(51) Int. Cl.
*F25D 23/10* (2006.01)
*F16M 13/02* (2006.01)
*E04B 1/98* (2006.01)

(52) U.S. Cl.
CPC . *F16M 13/02* (2013.01); *E04B 1/98* (2013.01)

(58) Field of Classification Search
CPC . F16M 2200/027; F16M 23/00; F16M 13/02; F24F 2221/16; F24F 13/32; F24F 1/60
USPC ..... 62/259.1, 298, 465, 466, 295; 165/76; 248/676, 544, 645, 649, 600, 680, 536; 52/27
See application file for complete search history.

(56) References Cited

U.S. PATENT DOCUMENTS 5,624,095 A * 4/1997 Zissu ..... 248/231.81
6,082,060 A * 7/2000 Bauer et al. ..... 52/173.3
7,059,086 B2 * 6/2006 Edvardsen ..... 52/58

* cited by examiner

*Primary Examiner* — Cassey D Bauer
(74) *Attorney, Agent, or Firm* — Thomas R. Lampe

(57) ABSTRACT

An air conditioner support system including a hold-down bracket for securing an air conditioner to a roof mounted air conditioner support, the hold-down bracket including a clip engageable with a rim portion of the support to maintain the hold-down bracket in position on the support.

20 Claims, 3 Drawing Sheets

AIR CONDITIONER ROOF SUPPORT SYSTEM

This application is a continuation-in-part of U.S. patent application Ser. No. 12/660,791, filed Mar. 4, 2010.

TECHNICAL FIELD

This invention relates to an air conditioner support system and more particularly to a system employing a hold-down bracket for securing an air conditioner to a roof mounted air conditioner support.

BACKGROUND OF THE INVENTION

It is well known to utilize hold-down brackets to secure air conditioners to roof mounted air conditioner supports, the latter also commonly known as roof jacks and roof curbs. The brackets are also known as seismic clips since they are utilized to maintain the interconnection between the air conditioner and the air conditioner support even during earthquakes.

Conventional hold-down brackets are of single-piece, non-adjustable construction. This becomes a problem because a number of different sizes of air conditioners and air conditioner supports exist and it is necessary to maintain an inventory of numerous sizes of hold-down brackets to adapt to the particular air conditioners and air conditioner supports employed.

My co-pending U.S. patent application Ser. No. 12/660,791 discloses a system employing an adjustable hold-down bracket for securing an air conditioner to a roof mounted air conditioner support, the bracket being secured by nails to the wooden core of a curb frame by nails extending through a retention panel of the bracket engaging the inner surface of the frame peripheral wall.

DISCLOSURE OF INVENTION

The present invention is applicable to air conditioner support systems formed of sheet metal which do not employ wooden frame cores. This is typically the situation for air conditioner supports utilized for lighter weight air conditioners such as residential roof mounted air conditioners. The hold-down bracket of the present invention is readily installed, simple and inexpensive in construction and includes a clip which not only facilitates installation but also acts to retain the hold-down bracket in place on the frame rim, final fixed securement being accomplished by use of a small number of metal screws extending through a bracket connector wall positioned against the outside of the frame peripheral wall.

According to the teachings of the present invention, a hold-down bracket is attachable to a roof mounted air conditioner support having an upwardly extending peripheral support wall having a distal end, a rim panel extending inwardly from said distal end and a downwardly extending rim portion attached to said rim panel defining a recess between said peripheral support wall and said rim portion.

The hold-down bracket is for securing an air conditioner to said air conditioner support.

The hold-down bracket is of unitary construction and has a first bracket structure for securement to the air conditioner support. The first bracket structure includes a clip engageable with said downwardly extending rim portion and having a clip end portion positionable in the recess.

A second bracket structure is connected to the first bracket structure for securement to the air conditioner. The first bracket structure and the second bracket structure jointly define an air conditioner receiving space for receiving a portion of said air conditioner.

In one of the embodiments of the present invention disclosed herein the hold-down bracket is of single-piece, integral construction.

Another embodiment of the hold-down bracket is adjustable for accommodating different sized air conditioner portions.

Other features, advantages and objects of the present invention will become apparent with reference to the following description and accompanying drawings.

MODES FOR CARRYING OUT THE INVENTION

Figures 1, 2:
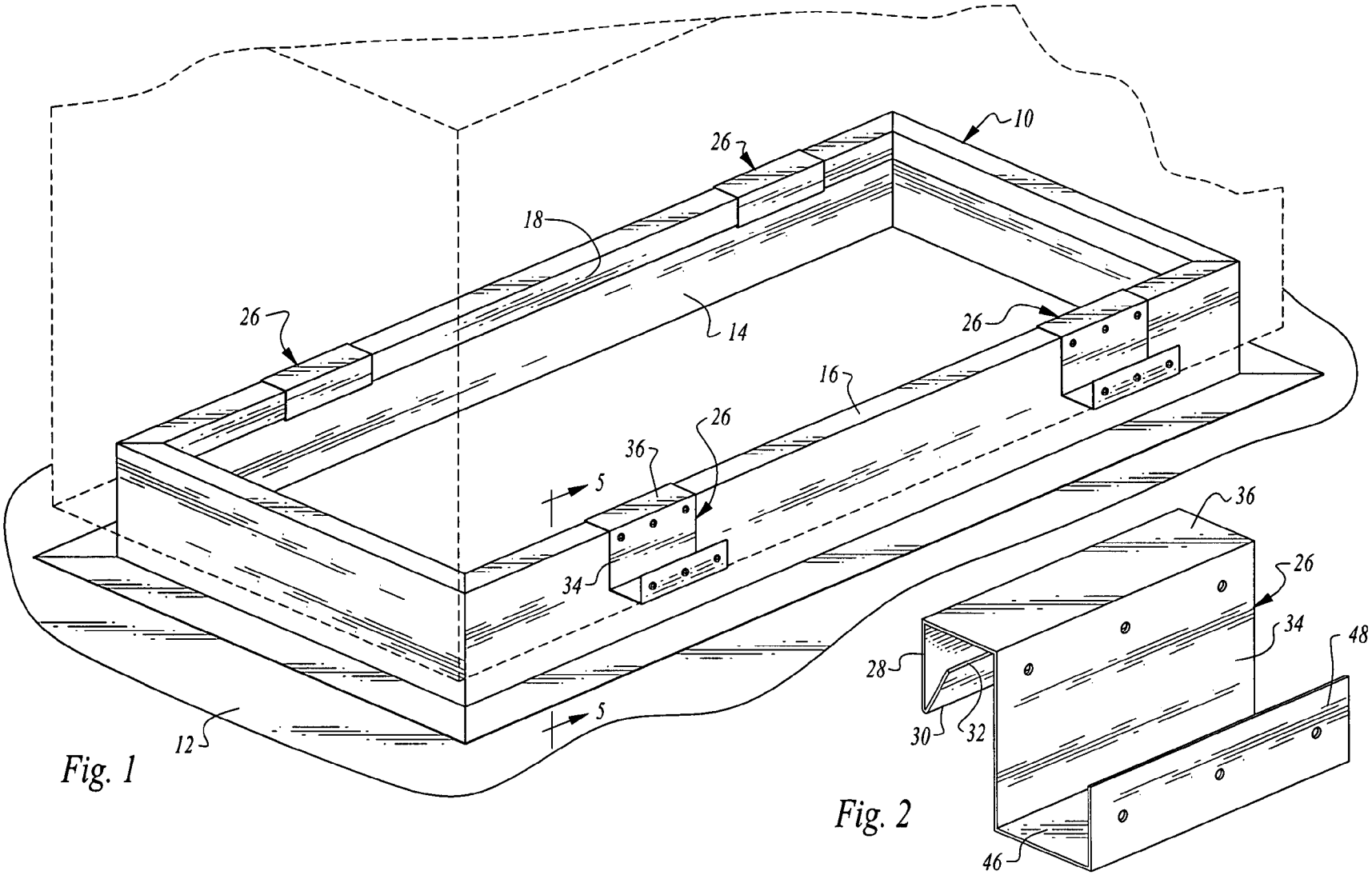
FIG. 1 is a perspective view illustrating a roof mounted air conditioner support of conventional construction having four hold-down brackets of a first embodiment of the invention attached thereto, an air conditioner being depicted by broken lines in place on the support and hold-down brackets.
FIG. 2 is an enlarged, perspective view illustrating the first embodiment of hold-down bracket.

Referring now to the drawings, a conventional roof mounted air conditioner support or curb 10 is illustrated. In FIG. 1 the air conditioner support is shown positioned on a roof 12. The air conditioner support is suitably formed of galvanized steel, aluminum or other suitable material and is of conventional construction. The air conditioner support 10 includes an upwardly extending peripheral support wall 14 having an upper distal end, a rim panel 16 extending inwardly from the distal end and a downwardly extending rim portion 18 attached to the rim panel.

The support wall 14 and the rim portion 18 define a recess 20. The recess is between the peripheral support wall and the rim portion.

As indicated above, the air conditioner support 10 is of conventional construction and is commonly employed to support lighter weight air conditioner units such as those typically employed on the roofs of houses.

FIG. 1 illustrates four hold-down brackets 26 constructed in accordance with the teachings of the present invention positioned on the support.

FIGS. 2-5 show all or portions of a single hold-down bracket 26. FIGS. 3-6 illustrate the bracket 26 along with a portion of the air conditioner support 10. In this particular embodiment of the support, the recess 20 is empty, having no inner wooden core positioned therein, the illustrated support being formed virtually exclusively of galvanized steel, aluminum or other suitable material.

The hold-down bracket 26 is suitably constructed of galvanized sheet metal, a material which is also employed in the manufacture of conventional hold-down brackets. The hold-down bracket 26 is of single-piece, integral construction. Materials other than galvanized sheet metal may be utilized.

The bracket 16 includes a first bracket structure 28 for securement to the air conditioner support 10 and includes a clip 30 engageable with the downwardly extending rim portion 18 of the air conditioner support and the clip having a clip end portion 32 positionable in the recess 20. This is shown, for example, in FIG. 5.

Figure 5:
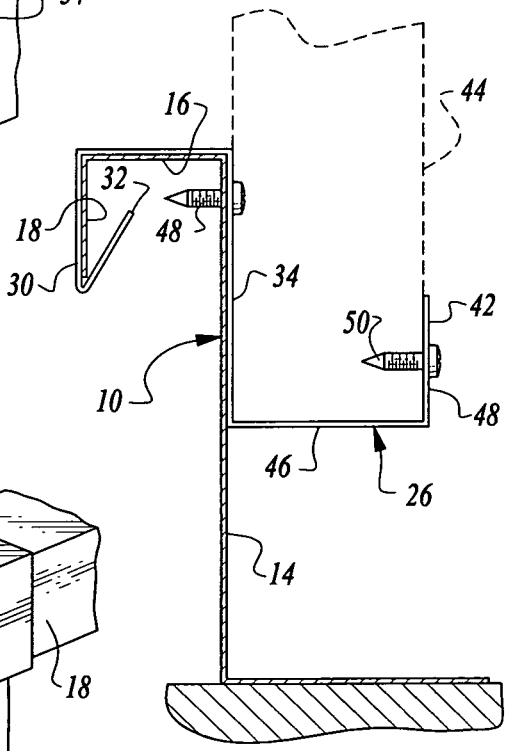
FIG. 5 is an enlarged, cross-sectional view illustrating the first embodiment secured to the air conditioner support by a sheet metal screw, a sheet metal screw also being depicted securing a portion of an air conditioner (shown in dash lines) to the hold-down bracket.
Figure 4:
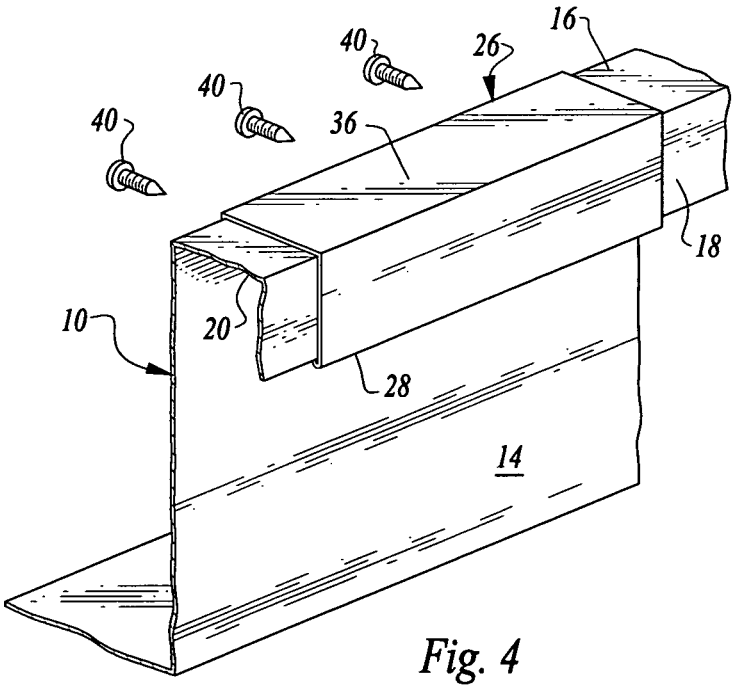
FIG. 4 is a depiction of the first embodiment of hold-down bracket in position on the air conditioner support and prior to being fixedly secured thereto by metal screws.
Figure 6:
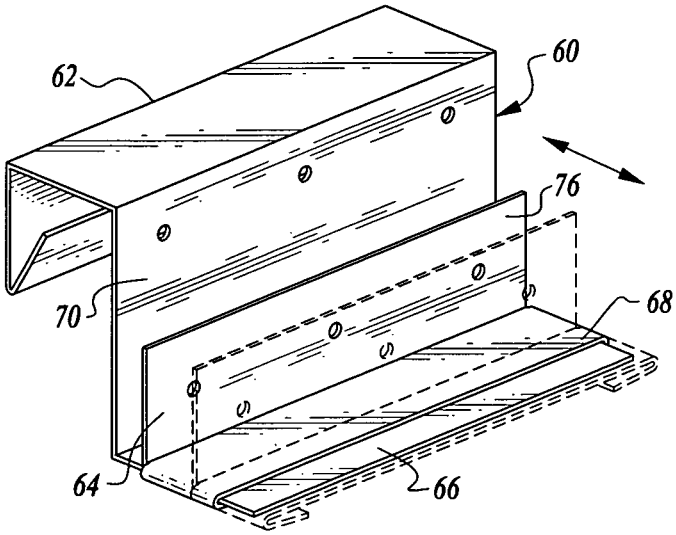
FIG. 6 is a perspective view illustrating a second embodiment of hold-down bracket, an adjustable component thereof being shown in alternative positions by solid line and dash line depictions.
Figure 7:
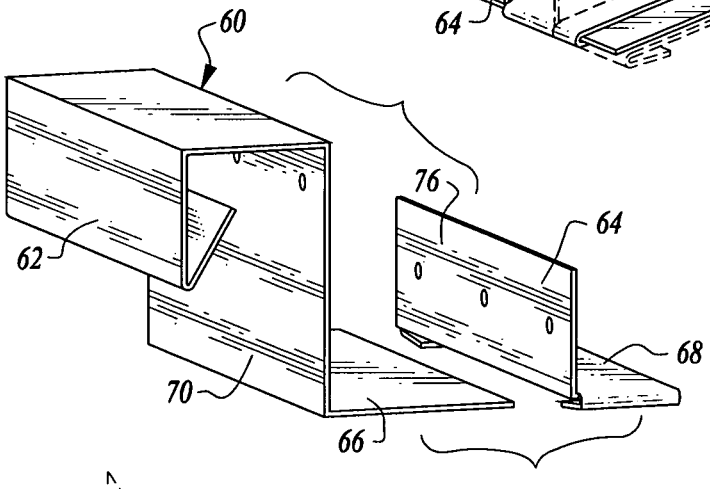
FIG. 7 is an exploded, perspective view illustrating structural components of the first embodiment of hold-down bracket prior to assembly.

The hold-down bracket 26 additionally includes a connector wall 34, an upper segment of the connector wall comprising a portion of the first bracket structure. The first bracket structure also includes a first bracket structure panel 36 connecting the upper portion of the connector wall 34 to the clip 30. The panel 36 is engageable with and supported by the rim panel 16 of the air conditioner support when the clip end portion is positioned in the recess 20. This is shown in FIGS. 4 and 5.

Figure 3:
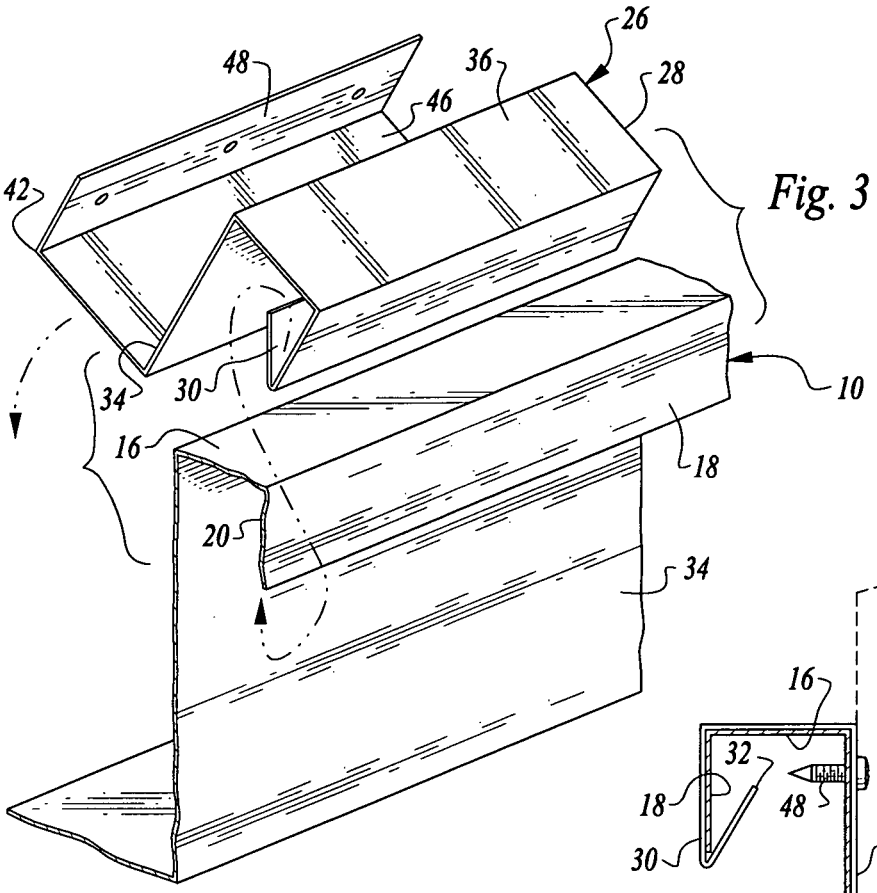
FIG. 3 is an enlarged, perspective view illustrating the first embodiment of hold-down bracket prior to placement on the air conditioner support, only a segment of the latter being illustrated.

To install the hold-down bracket 26 on the rim the hold-down bracket is manually tilted and then the clip 30 is positioned in recess 20 as shown by an arrow in FIG. 3. After this has been done, the hold-down bracket is tilted as shown by another arrow in FIG. 3 so that the panel 36 is positioned in place in engagement with rim panel 16 as illustrated in FIGS. 4 and 5. A vertical portion of the clip is disposed against rim portion 18 and the angularly disposed distal end portion is located in recess 20.

The hold-down bracket 26 may then be slid along the air conditioner support to the desired position thereon. Metal screws 40 are then employed to affix the hold-down bracket 26 in place. This is accomplished readily and quickly. Through utilization of the clip arrangement, metal screws need only be employed at the connector wall 34 to provide a safe and reliable attachment between the hold-down bracket and the air conditioner support.

The hold-down bracket 26 also includes a second bracket structure 42 connected to the first bracket structure 28 for securement to the air conditioner. The first bracket structure and the second bracket structure jointly define an air conditioner receiving space for receiving a portion of an air conditioner 44 (shown in dash lines in FIG. 5).

A lower segment of the connector wall 34 comprises a portion of a second bracket structure of the hold-down bracket 26. The second bracket structure 42 further includes a second bracket structure bottom 46 connected to and extending outwardly from the lower portion of the connector wall for engagement by the air conditioner portion to support the air conditioner. The second bracket structure additionally includes an upwardly extending sidewall 48 connected to the bottom and spaced from the connector wall for engagement with and securement to the air conditioner portion by metal screws or other suitable mechanical fasteners. One such screw 50 is shown in FIG. 5.

FIGS. 6-10 illustrate a second embodiment of hold-down bracket identified by reference numeral 60. Hold-down bracket 60 is also suitably formed from galvanized steel, aluminum or other material. The hold-down bracket 60 is adjustable for accommodating different sized air conditioner portions. More particularly, the hold-down bracket 60 includes relatively adjustable first and second bracket structural components 62, 64 for accommodating different sized air conditioner portions. Bracket structural components 62 and 64 are selectively movable relative to one another for engagement with the air conditioner portion to support the air conditioner. The first bracket structural component 62 includes a bottom member in the form of a flange 66. The second bracket structural component 64 includes a bottom member in the form of a flange 68. Flange 66 is flat and extends orthogonally relative to a connector wall or panel 70.

Figure 8:
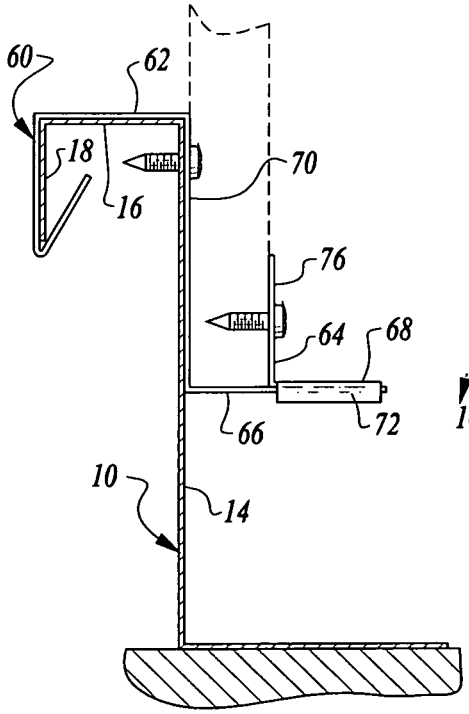
FIG. 8 is a view similar to FIG. 5, but illustrating the second embodiment of hold-down bracket secured by metal screws to hold an air conditioner portion, the latter shown in dash lines.
Figure 9:
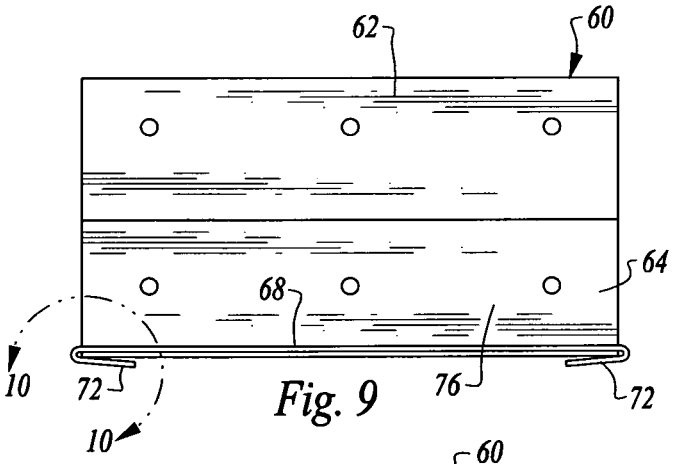
FIG. 9 is a frontal, elevational view illustrating the assembled second embodiment hold-down bracket.
Figure 10:
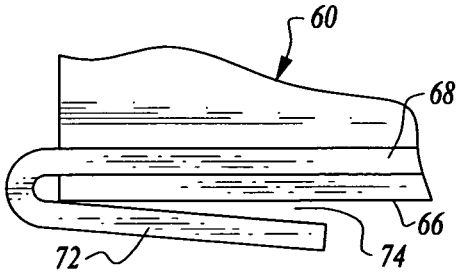
FIG. 10 is a greatly enlarged view showing a portion of the second embodiment encompassed by double headed arrow 10-10 of FIG. 9.

Flange 68 is folded over at its ends to form two lip portions 72 defining spaced recesses 74 for slidably receiving side portions of flange 66. See FIG. 10 illustrating details of one lip portion and recess. Flange 68 is attached to an upwardly extending end wall 76 spaced from the connector wall 70 when the first and second bracket structures are connected for engagement with and securement to the air conditioner portion by screws or other fasteners. FIG. 8 shows the upwardly extending end wall 76 secured to the air conditioner portion by a metal screw 80.

The invention claimed is:

1. A hold-down bracket attachable to a roof mounted air conditioner support having an upwardly extending peripheral support wall having a distal end, a rim panel extending inwardly from said distal end and a downwardly extending rim portion attached to said rim panel and defining a recess between said peripheral support wall and said rim portion, said hold-down bracket for securing an air conditioner to said air conditioner support, said hold-down bracket being of unitary construction and including, in combination:

a first bracket structure for securement to the air conditioner support and including a clip engageable with said downwardly extending rim portion and having a clip end portion positionable in said recess; and a second bracket structure connected to said first bracket structure for securement to the air conditioner, said first bracket structure and said second bracket structure jointly defining an air conditioner receiving space for receiving a portion of said air conditioner.

2. The hold-down bracket according to claim 1 additionally including a connector wall, an upper segment of said connector wall comprising a portion of said first bracket structure and a lower segment of said connector wall comprising a portion of said second bracket structure.

3. The hold-down bracket according to claim 2 wherein the first bracket structure includes a first bracket structure panel connecting the upper portion of said connector wall to said clip and engageable with and supported by the rim panel of said air conditioner support when said clip end portion is positioned in said recess.

4. The hold-down bracket according to claim 3 wherein the second bracket structure includes a second bracket structure bottom connected to and extending outwardly from the lower portion of said connector wall for engagement by said air conditioner portion to support said air conditioner.

5. The hold-down bracket according to claim 4 wherein said second bracket structure additionally includes an upwardly extending side wall connected to said bottom and spaced from said connector wall for engagement with and securement to said air conditioner portion by screws or other mechanical fasteners.

6. The hold-down bracket according to claim 1 of single-piece, integral construction.

7. The hold-down bracket according to claim 1 being adjustable for accommodating different sized air conditioner portions.

8. The hold-down bracket according to claim 1 wherein said second bracket structure includes relatively adjustable second bracket structural components for accommodating different sized air conditioner portions.

9. The hold-down bracket according to claim 8 wherein said relatively adjustable second bracket structural components comprise first and second bottom members selectively movable relative to one another for engagement with said air conditioner portion to support said air conditioner.

10. The hold-down bracket according to claim 9 wherein said first and second bottom members comprise slidably adjustable first and second overlapping flanges.

11. The hold-down bracket according to claim 10 wherein one of said flanges defines at least one recess receiving the other of said flanges.

12. The hold-down bracket according to claim 11 wherein said first and second bracket structures are formed of sheet metal, and the sheet metal of one of said first and second bracket structures defining said recess being folded over to define two spaced recesses for receiving the other of said flanges.

13. The hold-down bracket according to claim 8 wherein one of said bottom flanges is integral with the lower portion of the connector wall, the other of said bottom flanges being attached to an upwardly extending side wall spaced from said connector wall for engagement with and securement to said air conditioner portion by screws or other fasteners.

14. In combination:

a roof mounted air conditioner support having an upwardly extending peripheral support wall having a distal end, a rim panel extending inwardly from said distal end and a downwardly extending rim portion attached to said rim panel and defining a recess between said peripheral support wall and said rim portion; and a hold-down bracket securing an air conditioner to said air conditioner support, said hold-down bracket being of unitary construction and including a first bracket structure secured to the air conditioner support and including a clip engaging said downwardly extending rim portion and having a clip end portion positionable in said recess, and a second bracket structure connected to said first bracket structure secured to the air conditioner, said first bracket structure and said second bracket structure jointly defining an air conditioner receiving space receiving a portion of said air conditioner.

15. The combination according to claim 14 additionally including a connector wall, an upper segment of said connector wall comprising a portion of said first bracket structure and a lower segment of said connector wall comprising a portion of said second bracket structure.

16. The combination according to claim 15 wherein the first bracket structure includes a first bracket structure panel connecting the upper portion of said connector wall to said clip engaged with and supported by the rim panel of said air conditioner support.

17. The combination according to claim 16 wherein the second bracket structure includes a second bracket structure bottom connected to and extending outwardly from the lower portion of said connector wall engaged by said air conditioner portion and supporting said air conditioner.

18. The combination according to claim 17 wherein said second bracket structure additionally includes an upwardly extending side wall connected to said bottom and spaced from said connector wall engaged with and secured to said air conditioner portion by screws or other mechanical fasteners.

19. The combination according to claim 14 wherein said second bracket structure includes relatively adjustable second bracket structural components for accommodating different sized air conditioner portions, said relatively adjustable second bracket structural components comprising first and second bottom members selectively movable relative to one another for engagement by said air conditioner portion to support said air conditioner.

20. The combination according to claim 19 wherein said first and second bottom members comprise slidably adjustable first and second overlapping flanges.

* * * * *